US011535495B2

(12) United States Patent
Donnelly

(10) Patent No.: US 11,535,495 B2
(45) Date of Patent: Dec. 27, 2022

(54) LIFT ASSEMBLY FOR BLOCKS AND METHOD OF LIFTING BLOCKS

(71) Applicant: Construction Specialties, LLC, Framingham, MA (US)

(72) Inventor: Thomas F. Donnelly, Framingham, MA (US)

(73) Assignee: Construction Specialties, LLC, Framingham, MA (US)

( * ) Notice: Subject to any disclaimer, the term of this patent is extended or adjusted under 35 U.S.C. 154(b) by 0 days.

(21) Appl. No.: 17/319,279

(22) Filed: May 13, 2021

(65) Prior Publication Data

US 2022/0363517 A1 Nov. 17, 2022

(51) Int. Cl.
*B66C 1/30* (2006.01)
*E02D 29/02* (2006.01)

(52) U.S. Cl.
CPC ..... *B66C 1/30* (2013.01); *E02D 29/0266* (2013.01)

(58) Field of Classification Search
CPC .... B66C 1/30; B66C 1/54; B66C 1/42; E02D 29/0266; B65G 61/00; E04G 21/162; B66F 9/18
See application file for complete search history.

(56) References Cited

U.S. PATENT DOCUMENTS 329,389 A 10/1885 Hosner
1,729,467 A 9/1929 Whyte
4,460,210 A * 7/1984 Miechur ..... B66C 1/54 294/97
4,474,400 A * 10/1984 Toffolon ..... E04G 21/16 294/97
5,893,595 A 4/1999 Corbett
6,513,847 B2 * 2/2003 Harris ..... B66C 1/66 294/63.1
6,821,058 B1 11/2004 Dawson
8,454,065 B2 * 6/2013 Wolford ..... B66C 1/16 294/81.5

(Continued)

FOREIGN PATENT DOCUMENTS

KR 10-2010-0135379 A 12/2010

OTHER PUBLICATIONS

Keystone Retaining Wall Systems, "Keystone Tools, Miscellaneous", 2017, <https://www.keystonewalls.com/products/miscellaneous/keystone-tools>.

(Continued)

*Primary Examiner* — Carib A Oquendo
(74) *Attorney, Agent, or Firm* — Nields, Lemack & Frame, LLC.

(57) ABSTRACT

Lifting apparatus for lifting, conveying and/or positioning blocks or slabs, such as blocks or slabs made of concrete, masonry, stone, brick, or similar materials, and methods of lifting, conveying and/or positioning such materials. The lifting apparatus may include two spaced block supporters that are positioned or positionable to respectively mechanically engage a block or slab to support the same mechanically. Upon biasing the two spaced block supporters, the block is engaged and its weight supported, and the block may be lifted, conveyed and/or positioned at a desired location. Unbiasing the block supporters releases the block. A plurality of lifting apparatuses may be used together, including in modular form.

15 Claims, 16 Drawing Sheets

(56) References Cited

U.S. PATENT DOCUMENTS

| | | | | |
|---|---|---|---|---|
| 8,464,491 | B2 | 6/2013 | MacDonald et al. | |
| 8,480,145 | B2 * | 7/2013 | Eastall | B66C 1/30 294/67.31 |
| 8,656,678 | B2 | 2/2014 | MacDonald | |
| 9,028,175 | B2 | 5/2015 | Friederichs et al. | |
| 9,902,600 | B2 * | 2/2018 | Hammer | E04B 2/08 |
| 10,919,735 | B2 * | 2/2021 | Plank | B66C 1/422 |
| 2006/0059817 | A1 * | 3/2006 | Fleming | B66C 1/442 52/379 |
| 2012/0068485 | A1 * | 3/2012 | Risi | B66C 1/28 294/119 |
| 2015/0167260 | A1 | 6/2015 | Siqueiros | |

OTHER PUBLICATIONS

Aardwolf Industries LLC, "Stone lifter, versa block clamp, lifting and moving concrete blocks, rubber tyres, drums (AVBC1100)", Oct. 17, 2019, <https://www.youtube.com/watch?v=nY_PYifExsY>.

Aardwolf Industries LLC, "Horizontal Stone Lifting Clamp—AHLC-730", 2008, <https://www.aardwolf.com.au/index.php?c=107&p=652>.

* cited by examiner

LIFT ASSEMBLY FOR BLOCKS AND METHOD OF LIFTING BLOCKS

BACKGROUND

Retaining walls are used for sites that feature difficult sloping terrain and where there is a need to maintain maximum developable area, earthen formations, or for locations requiring abrupt grade change, such as bridge abutments. Ideally, retaining wall systems are easy to stage and install, reduce construction time and costs and provide long-term durability, performance and structural integrity. They can address both structural and landscaping needs in a wide variety of markets, including transportation, industrial, commercial and residential markets.

These systems can be used in a wide range of applications, including the construction of large structural walls to small-tiered gardens. The blocks may be made of a variety of materials, including machine made concrete, pre-cast, natural stone and masonry. Segmental concrete retaining wall units typically are dry stacked (built without mortar).

To construct retaining walls, the blocks are typically stacked on top of one another in a staggered fashion to enhance the strength of the wall; for example a block may be placed on top of two underlying blocks in an overlapping arrangement so that about half of the upper block rests on one of the underlying blocks and the remaining half of the upper block rests on the other underlying block. Other arrangements are also possible.

In view of the number of blocks that must be conveyed and positioned to construct a wall, and the weight of such blocks, mechanical lifting devices would be helpful to facilitate the foregoing. Conventional lifting apparatus typically includes gripper members that are positioned to frictionally engage opposite outer sides of a block. Upon raising the lifting apparatus, the block is lifted off the ground or off a supporting surface, and can be conveyed and positioned where desired. Once positioned, the gripper members of the lifting apparatus may be released from engagement with the block. Some blocks have built-in attachment elements that connect to the lifting apparatus for this purpose.

However, such friction-based systems are prone to failure, often due to the variable and unpredictable nature of the blocks and/or lifting apparatus, as well as the uneven or unstable terrain over which the blocks are often carried.

It would be desirable to provide an apparatus for concrete blocks, stone, masonry blocks and the like that facilitates the lifting, conveying and/or positioning of said materials, as well as a method of lifting, conveying and/or positioning the same. It also would be desirable to provide modular apparatuses comprised of a plurality of lifting apparatuses that cooperate with one another to lift, convey and/or position a plurality of blocks or slabs.

These and other objects and advantages of the embodiments disclosed herein and advantageous features thereof will become apparent as the description proceeds herein.

SUMMARY

Problems of the prior art have been addressed by the embodiments disclosed herein. Embodiments relate to a lifting apparatus for mechanically lifting, conveying and/or positioning blocks or slabs, such as blocks or slabs made of concrete, masonry, stone, brick, or similar materials, and methods of mechanically lifting, conveying and/or positioning such materials, such as to form or construct a wall. In some embodiments, the lifting apparatus includes two spaced block supporters that are positioned or positionable to mechanically support the underside of a block or slab. In some embodiments, one of the block supporters accesses the underside of the block or slab through an interior or inner wall of a void region or core in the block or slab, and another of the supporters accesses the underside of the block or slab alongside an exterior wall of the block or slab. In another embodiment, both of the supporters access the underside of the block or slab alongside a respective exterior wall of the block or slab. In yet another embodiment, both of the supports access the underside of the block or slab through one or more internal or interior void regions or cores in the block or slab, defined by one or more interior walls. In any of the embodiments, upon biasing the two spaced block supporters towards or away from each other, as the case may be, the block is engaged and supported by the first and second supporters, and may be lifted, conveyed and/or positioned at a desired location. In some embodiments, the two spaced block supporters support the full weight of the block. Unbiasing the block supporters releases the block.

In some embodiments, the lifting apparatus can be arranged in modular form, or a plurality of lifting apparatus can be integral or permanently attached. In such embodiments, more than one lifting apparatuses cooperate to lift, convey and/or transport a plurality of blocks or slabs. In some embodiments, the plurality of blocks or slabs are lifted at the same time. In other embodiments, the plurality of blocks or slabs are lifted at different times. In some embodiments, the plurality of blocks or slabs are lifted at the same time but not all of the plurality are disengaged at the same time; e.g., one or more of the plurality of blocks may be positioned and disengaged at a different time than other blocks of the plurality of blocks.

In its method aspects, embodiments disclosed herein include a method of lifting, conveying and/or positioning a block or slab having an internal void or core, comprising: positioning a first block supporter of a lifting apparatus in an internal void or core of the block or slab, the internal void or core being defined by at least one inner or internal wall of the block or slab; positioning a second block supporter of a lifting apparatus alongside or near an external wall of the block or slab, the first and second supporters being in a first block release position; moving the first and second supporters to a second block engage position underneath the block or slab, biasing the first and second block supporters towards each other, thereby moving the first and second supporters underneath the block or slab to a block or slab supporting position; and raising the lifting apparatus to mechanically lift the block or slab off of a surface. The block may be conveyed to a predetermined location and released from the first and second supporters. These steps may be repeated a plurality of times with a plurality of blocks so as to construct a structure such as a wall, for example.

In another embodiment, steps are the same except that both block supporters are positioned in the same or different internal voids or cores of the block or slab, and the first and second support biased away from each other so that they each locate underneath the block in a block supporting position. In yet another embodiment, both the first and second supporters are each positioned alongside or near respective exterior walls of the block or slab in a first block release position, followed by moving the first and second supporters to a second block engage position underneath the block or slab, biasing the first and second block supporters towards each other, thereby moving the first and second supporters underneath the block or slab to a block or slab supporting position; and raising the lifting apparatus to mechanically lift the block or slab off of a surface. The block may be conveyed and positioned to a desired location and released from the supporters. This operation may be repeated to construct a wall composed of a plurality of blocks arranged in predetermined arrays or patterns, for example. The block may be solid; e.g., it may be a block without a core or void. In some embodiments, the method includes lifting, conveying and/or positioning a plurality of blocks or slabs with a plurality of lifting apparatuses that are integral or are assembled in modular form and cooperate to simultaneously lift and convey the plurality of blocks or slabs.

DETAILED DESCRIPTION

Figure 1:
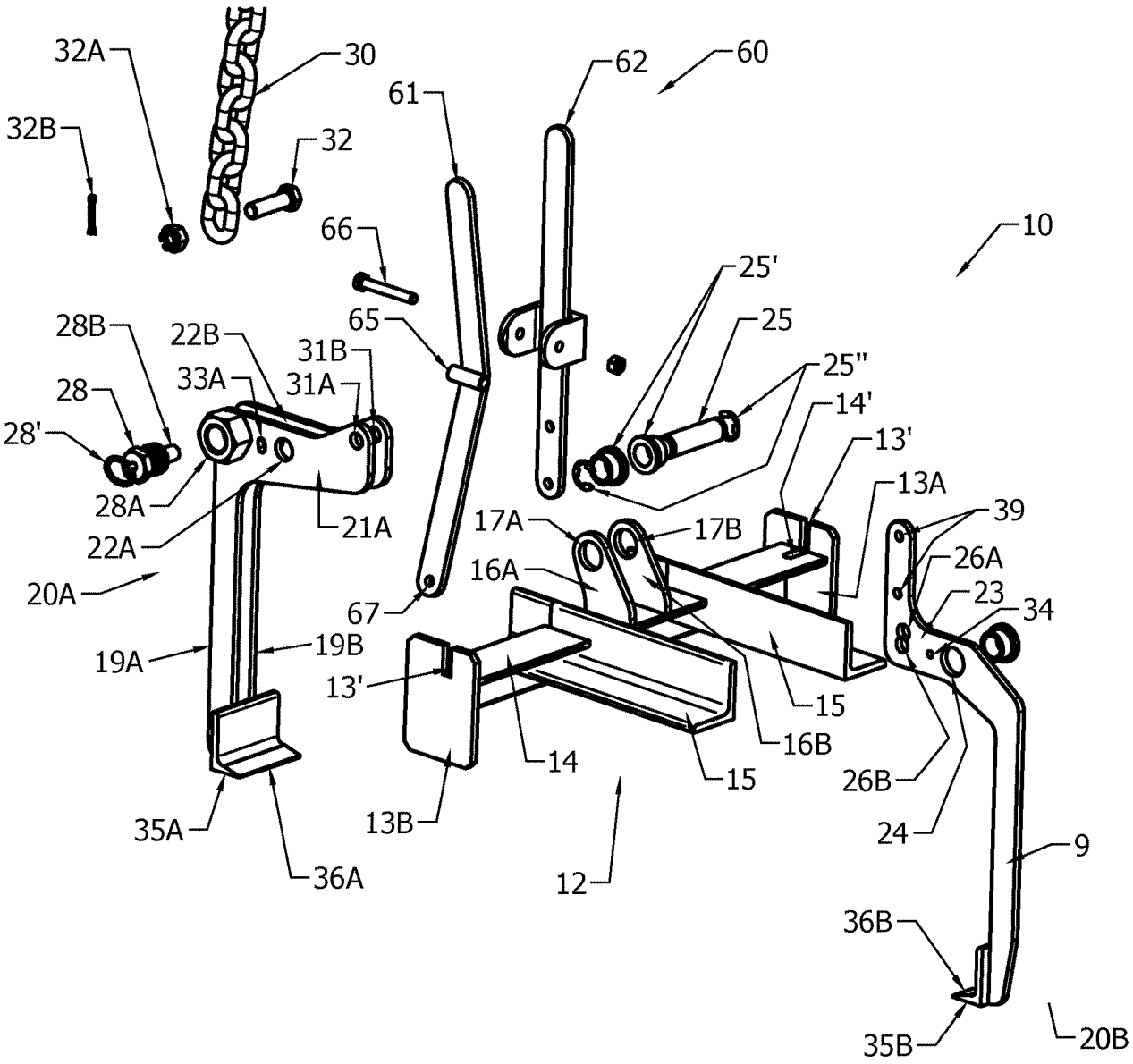
FIG. 1 is an exploded view of a lifting apparatus in accordance with certain embodiments.

A more complete understanding of the components, processes and devices disclosed herein can be obtained by reference to the accompanying drawings. The figures are merely schematic representations based on convenience and the ease of demonstrating the present disclosure, and is, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification, various devices and parts may be described as "comprising" other components. The terms "comprise(s)," "include(s)," "having," "has," "can," "contain(s)," and variants thereof, as used herein, are intended to be open-ended transitional phrases, terms, or words that do not preclude the possibility of additional components.

Figure 2:
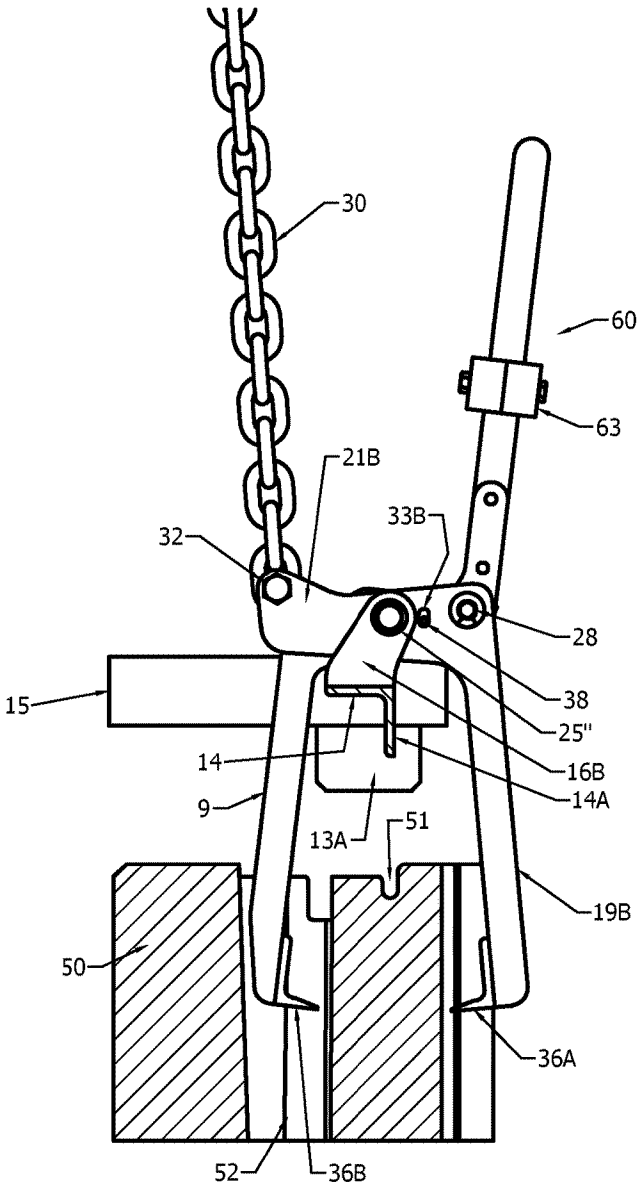
FIG. 2 is a side view, partially in cross-section, of a lifting apparatus in an open, unlocked and block unsupported position in accordance with certain embodiments.

Turning now to FIG. 1, there is shown one embodiment of a lifting apparatus 10. In the embodiment shown, there is a main frame 12 that includes opposite spaced block alignment plates 13A, 13B, each attached to a free end of horizontal alignment bar 14. In some embodiments the horizontal alignment bar 14 may be a flat bar. In other embodiments, the horizontal alignment bar 14 may be an L-shaped bar having a leg 14A as seen in FIG. 2, the leg 14A of which may be accommodated by a groove 51 formed in the block being raised (FIGS. 2-5) when in a block supported position. In some embodiments, the main frame 12 may include one or more block stabilizers 15 (two shown) which may be L-shaped and attached to or supported by the horizontal alignment bar 14, such as by welding. The block stabilizer(s) 15, if present, can function to help stabilize a block during the lifting, conveying, lowering and/or positioning process. For example, when a block is engaged and supported by the lifting apparatus 10, the underside of the block stabilizer(s) is positioned to contact (e.g., a top surface of the block) and thereby limit the movement of the block while it is supported by the lifting apparatus 10. The main frame 12 and one or more of its components (e.g., the alignment plates, alignment bar, scissor attachment brackets, etc.) may be a single, integral continuous piece formed from sheet metal, for example, or from a plastic resin or fiberglass, such as by molding.

In certain embodiment, the main frame 12 also includes a pair of spaced scissor attachment brackets 16A, 16B are attached to the upper surface of the horizontal alignment bar 14, again such as by welding. Each scissor attachment bracket 16A, 16B may include a respective through-hole 17A, 17B configured to receive a pivot pin 25 or the like and front and back retainer rings 25" to pivotally connect mechanical scissor grips 20A, 20B as discussed in greater detail below.

In some embodiments, mechanical scissor grip 20A includes two spaced apart L-shaped or substantially L-shaped members having legs 19A, 19B and arms 21A, 21B, the arms having aligned apertures 22A, 22B as shown. The arms 21A, 21B may be positioned so that when assembled, the apertures 22A, 22*b* align with the through-holes 17A, 17B of the scissor attachment brackets 16A, 16B. In some embodiments, mechanical scissor grip 20B includes a single leg 9 and arm 23, the arm 23 having an aperture 24. When assembled, the arm 23 may be positioned, such as within the space between the arms 21A, 21B of the mechanical scissor grip 20A, so that the aperture 24 aligns with the through-holes 17A, 17B of the scissor attachment brackets 16A, 16B. A pivot bolt, pin or the like 25 may be received through the through-holes 17A, 17B, aperture 24 and apertures 22A and 22B and secured with retainer rings 25" to pivotally attach the mechanical scissor grips 20A and 20B to the main frame 12.

Figure 4:
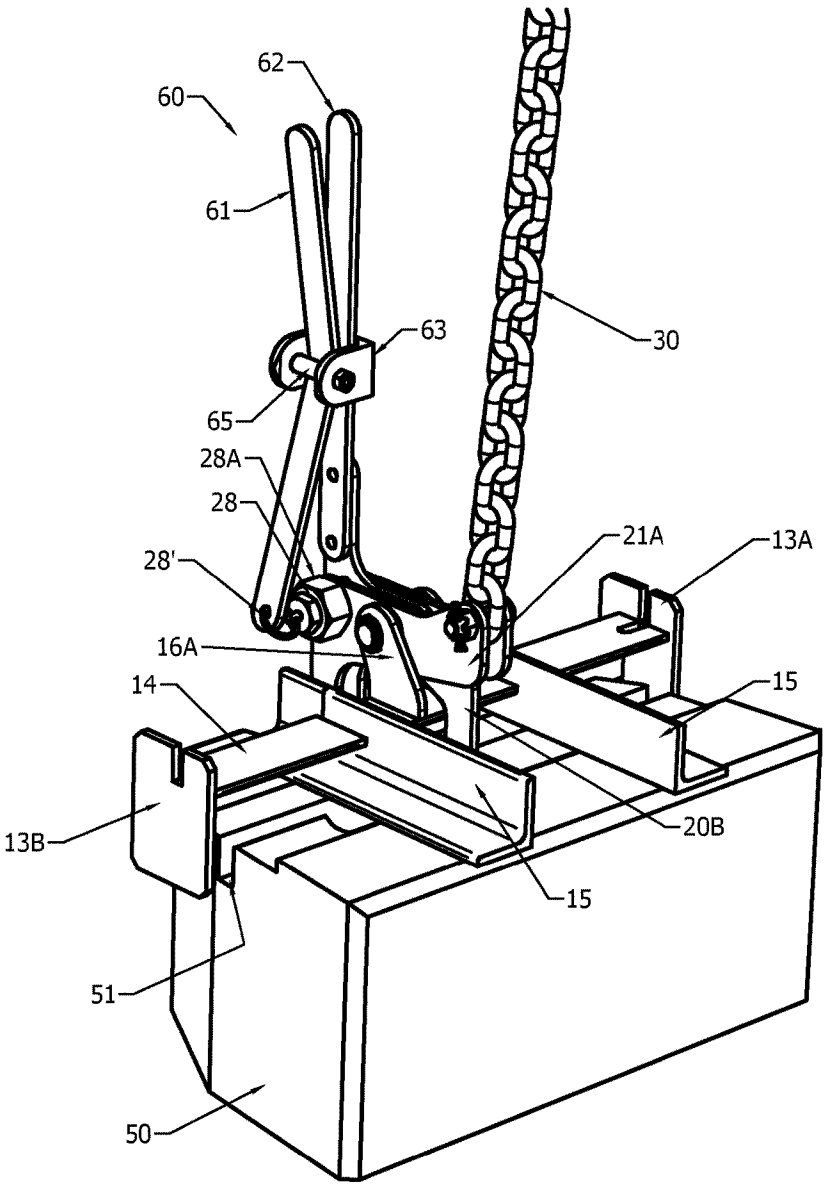
FIG. 4 is a perspective view of a lifting apparatus just prior to engaging and supporting a block in accordance with certain embodiments.
Figure 5:
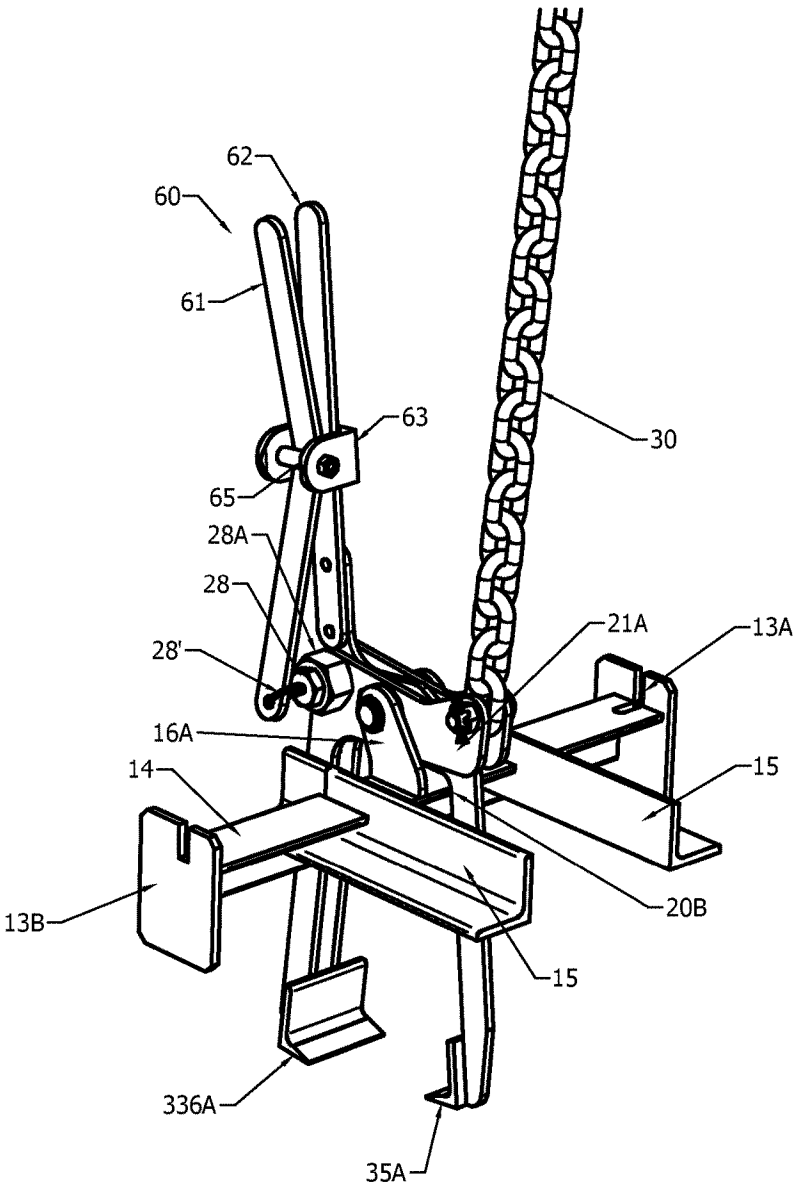
FIG. 5 is a perspective view of a lifting apparatus in accordance with certain embodiments.

In certain embodiments arms 21A, 21B of mechanical scissors grip 20A also have a second set of aligned apertures 27A, 27B that receive a scissor open and close lock spring pin 28 or the like. The lock spring pin 28 may thread into bolt 28A and may include a spring or biasing arm 28B that is normally biased in a closed or locked positioned where the biasing arm 28B is positioned in the apertures 27A, 27B (and one of apertures 26A, 26B as discussed below). The lock spring pin 28 when in the locked position, prevents the opening or rotation of the scissors grips. Arm 23 of mechanical scissors grip 20B has apertures 26A, 26B (which can be two separate apertures or, as shown in the figures, a single aperture shaped to receive biasing arm 28B in two distinct locations) that are alignable with aperture 27A, 27B when the mechanical scissors grip 20B is positioned in place between the space between scissor attachment brackets 16A, 16B and arms 21A, 21B of mechanical scissors grip 20A, as seen in FIGS. 4 and 5. When the biasing arm 28B of lock spring pin 28 is positioned in aperture 26A, the mechanical scissors grips are locked in the open and block engageable position, and when the biasing arm 28B of lock spring 28 is positioned in aperture 26B, the mechanical scissors grips are in the locked or closed, block engaged positioned. The distance between apertures 26A and 26B, as well as the angle between their respective centers, defines the relative distance the mechanical scissors grips travel with respect to each other between the open and closed positions.

In certain embodiments arms 21A, 21B of mechanical scissors grip 20A have a third set of aligned apertures 31A, 31B that receive pin or bolt 32 and corresponding nut or retainer 32A to secure a lift chain, rope or other tether 30 to the mechanical scissor grip 20A when the chain is positioned in the space between arm 21A, 21B, as best seen in FIGS. 4 and 5. Preferably the nut includes a radial through-hole to receive a cotter pin 32B to prohibit the nut from inadvertently loosening or falling off such as due to vibration. In some embodiments, a carabiner type attachment clip may be used to attach the tether 30 to the bolt 32, and/or to attach the tether 30 to a spreader bar 100 or the like. For example, the carabiner attachment clip may be looped through a chain link in the tether 30 and then snap attached. This allows the chain length to be adjusted (by choosing which link to attach the clip to) and allows for quickly swapping/releasing of the modular lifting units from either end of the chain allowing for "hot swapping units". For example, a first set of lifting apparatuses (e.g., a set of four) may be tethered to a spreader bar 100 that is configured to tether to eight lifting apparatuses (FIG. 8), the first set of four tethered units each holding and supporting respective blocks. The spreader bar 100 with these tethered units may be manipulated to convey and place or release the four blocks at a desired location. During this operation, additional lifting apparatuses (e.g., a second set of four lifting apparatuses) at a different location omay be set up so that they are engaging respective blocks, waiting for the spreader bar 100 to arrive with the first set of tethered units that now no longer hold blocks. When the spreader bar 100 arrives at the location of the second set of lifting appartuses, the first set may be untethered from the spreader bar 100 such as by unclipping the carabiner attachment clips, and the second set tethered to it, such as by clipping the carabiner attachments clips. The second set is then conveyed to a desired location to release or place its blocks while the first set is being loaded again with new blocks, waiting for the spreader bar 100 to arrive.

Optionally, a fourth set of aligned apertures comprising apertures 33A, 33B in mechanical scissors grip 20A and aperture 34 in mechanical scissors grip 20B may be present and configured to receive a pin 38 (FIG. 2) to help limit rotation of the mechanical scissors grips.

Figure 3:
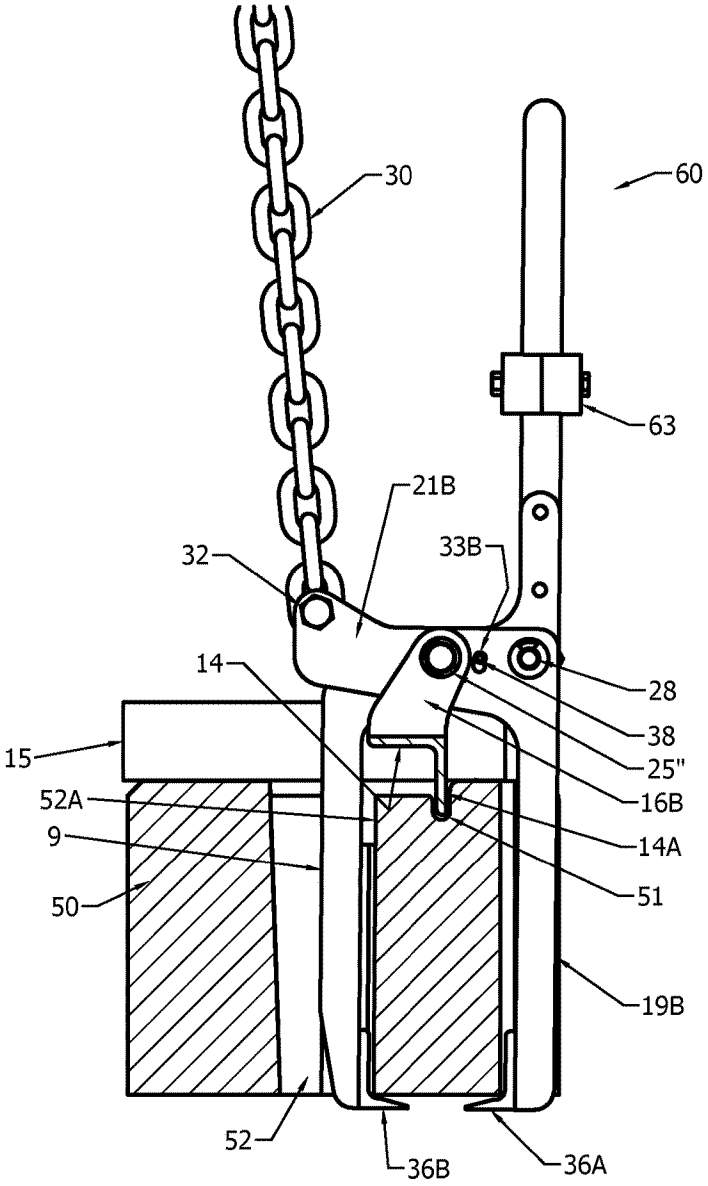
FIG. 3 is a side view, partially in cross-section, of a lifting apparatus in a block-engaged and supported positioned in accordance with certain embodiments.

In certain embodiments, arm 23 of mechanical scissors grip 20B may include one or more through holes 39 (two shown) to receive an extension handle 60 (via apertures 69) that may be used to allow for manually assisting the movement of the mechanical scissors grip between a block unengaged position (FIG. 2) and a block engaged and supported position (FIG. 3). This is particularly helpful where there is no or only a minimal gap between the underside of a block and the substrate supporting it (which may be another block). In some embodiments, the handle 60 may be a spring pin release handle and may include a first bent member 61 that pivotally connects to a second generally straight member 62, such as with C-shaped bracket 63 that includes spaced apertures 64A, 64B that align with bored cylindrical member 65 that receives pin 66. In one embodiment an aperture 67 in bent member 61 receives ring 28' of the locking pin 28. The spring pin release handle allows the operator to release the biasing arm 28B of the locking pin 28 (e.g., move it axially) while providing leverage to move the mechanical scissor grips 20A, 20B from a locked or unlocked position to the unlocked or locked position. This operation can be carried out with a single hand by grasping both the bent member 61 and straight member 62, preferably near the top free ends thereof and squeezing or biasing the two members towards each other.

In some embodiments, each of the mechanical scissors grips 20A, 20B includes a block support angle 35A, 35B at or near the respective free ends of legs 19A, 19B. In certain embodiments, the respective block support angles 35A, 35B are generally L-shaped and have support legs 36A, 36B that extend towards the main frame 12 and function to engage the underside of a block and support the block during lifting, conveying and positioning operations. In some embodiments, the support legs 36A, 36B may be chiseled or tapered to towards their free ends to facilitate their engagement with the underside of the block or slab.

Figure 14:
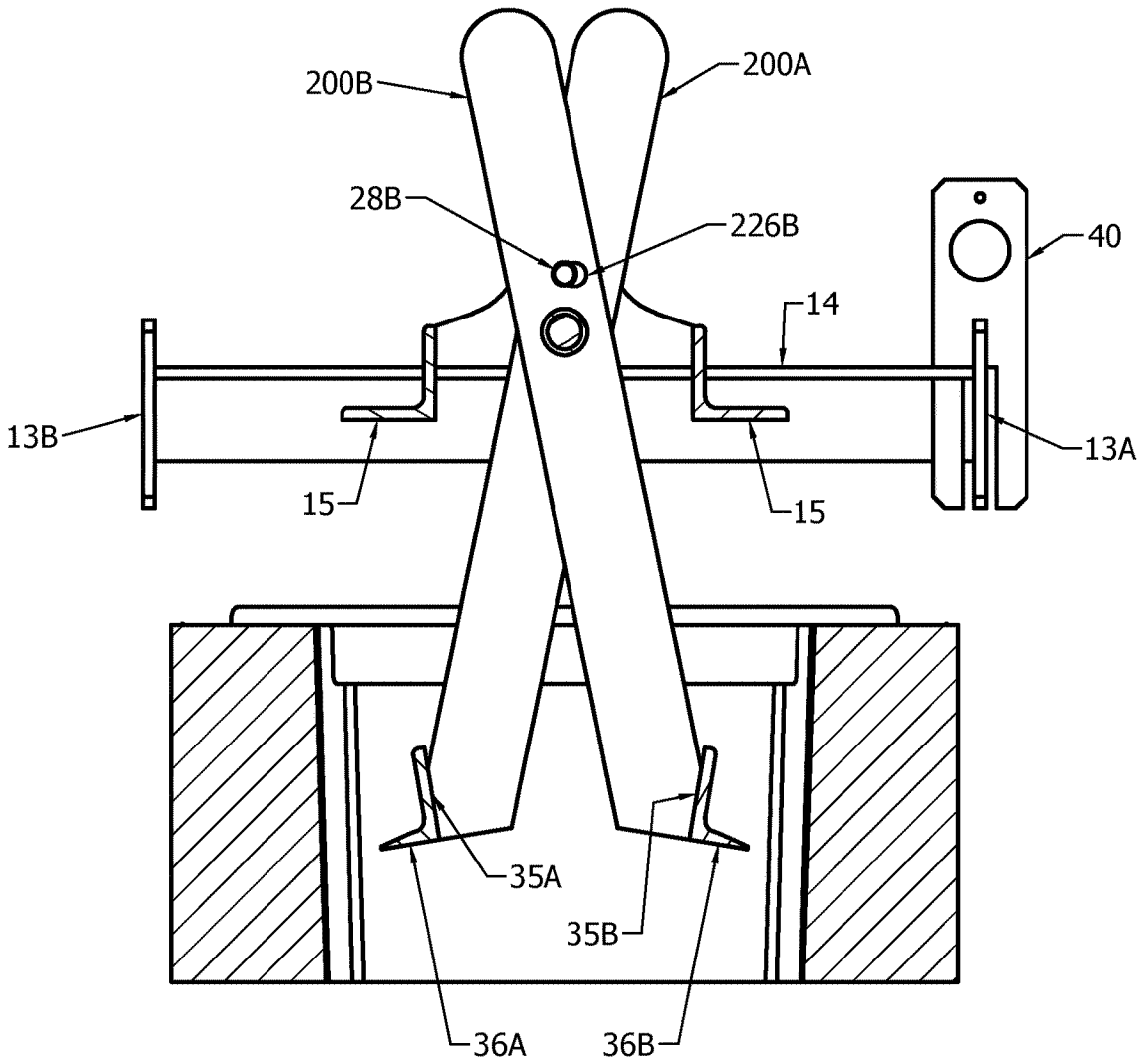
FIG. 14 is a front view, partially in cross-section, of the lifting apparatus of FIG. 13 showing the mechanical scissors grips positioned in a void or core of a block.
Figure 15:
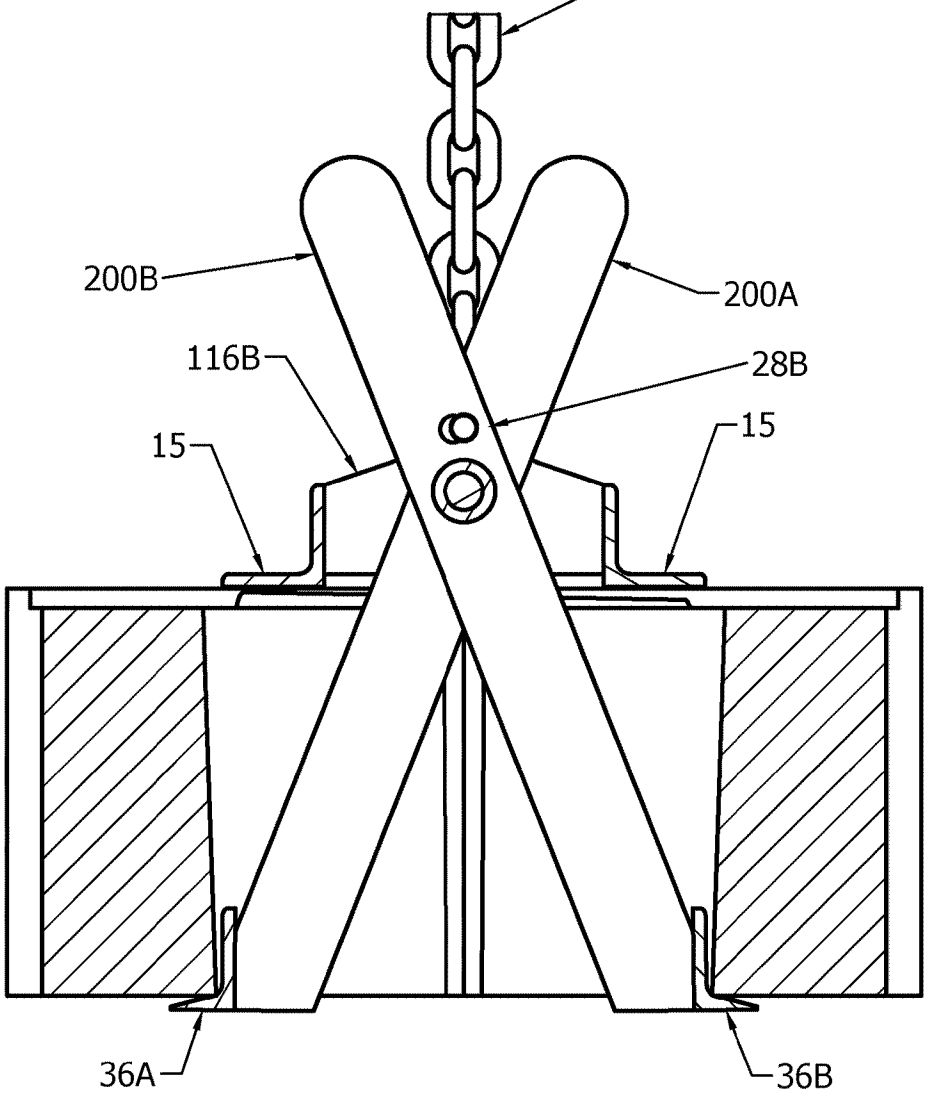
FIG. 15 is a rear view, partially in cross-section, of the lifting apparatus of FIG. 13 shown in a block supporting position.

FIGS. 13-16 illustrate an alternative embodiment of a lifting apparatus where like numerals indicate similar structure to those of previous embodiments. In this alternative embodiment, spaced scissor attachment brackets 116A, 116B are attached or integral to block stabilizers 15. Each scissor attachment bracket 116A, 116B may include a respective through-hole 117A, 117B configured to receive a pivot pin 25 or the like and front and back retainer rings 25" to pivotally connect mechanical scissor grips 200A, 200B to the spaced scissor attachment brackets 116A, 116B via respective through-holes 127A, 127B of the scissor attachment brackets 116A, 116B, as seen in FIGS. 14 and 15.

Each scissor attachment bracket 116A, 116B also may include respective apertures 119A, 119B that are positioned and configured to receive the biasing arm 28B of spring pin 28. Mechanical scissors grip 200B has apertures 226A, 226B (which can be two separate apertures or, as shown in the figures, a single aperture shaped to receive biasing arm 28B of spring pin 28 in two distinct locations) that are alignable with aperture 227 of mechanical scissors grips 200A and with apertures 119A, 119B of scissor attachments brackets 116A, 116B. When the biasing arm 28B of lock spring pin 28 is positioned in aperture 226A, the mechanical scissors grips are locked in the open and block engageable position (FIG. 14), and when the biasing arm 28B of lock spring 28 is positioned in aperture 226B, the mechanical scissors grips are in the locked or closed, block engaged positioned (FIGS. 15, 16A and 16B).

In some embodiments, each of the mechanical scissors grips 200A, 200B includes a block support angle 35A, 35B at or near the respective free ends thereof. In certain embodiments, the respective block support angles 35A, 35B are generally L-shaped and have support legs 36A, 36B that extend away from each other and function to engage the underside of a block and support the block during lifting, conveying and positioning operations (FIG. 15). In some embodiments, the support legs 36A, 36B may be chiseled or tapered to towards their free ends to facilitate their engagement with the underside of the block or slab.

Figure 16A:
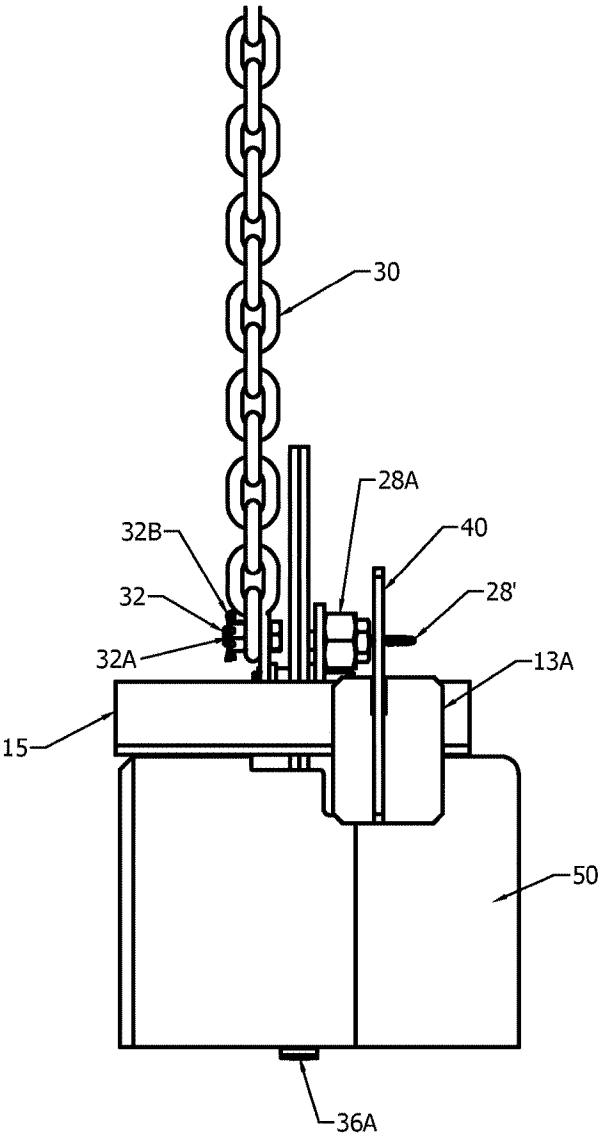
FIG. 16A is a side view of the lifting apparatus of FIG. 13 with the mechanical scissors grips shown in a block supporting position.
Figure 16B:
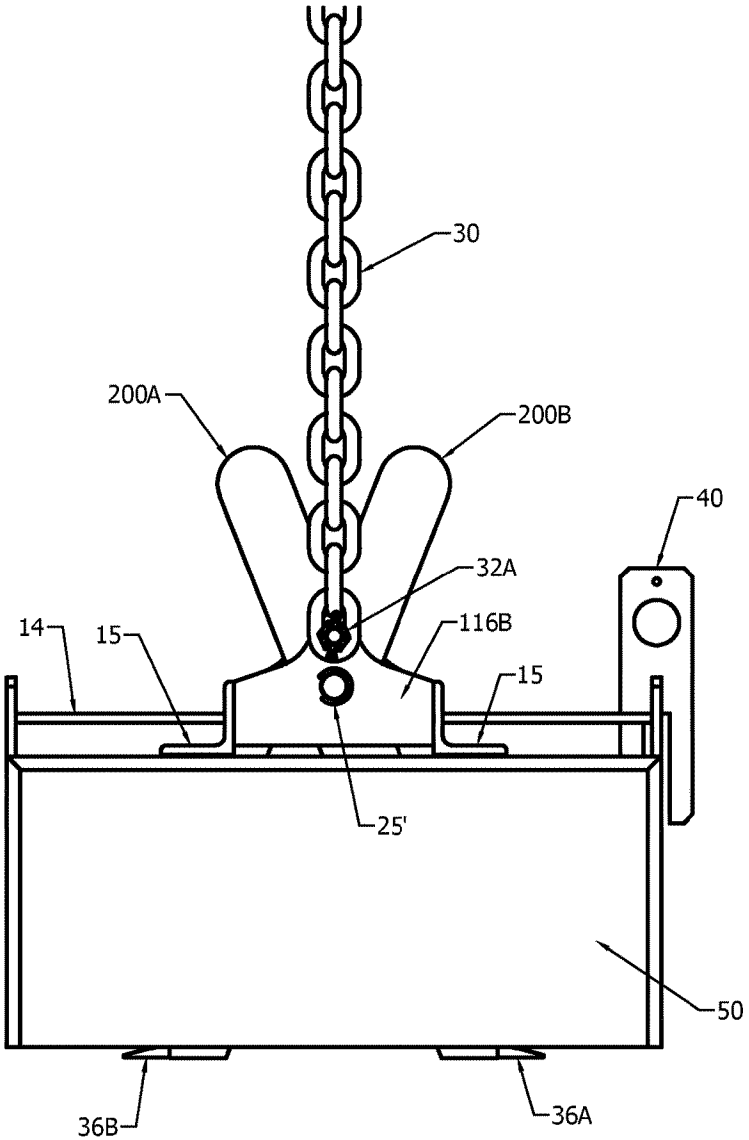
FIG. 16B is a front view taken along line 16B-16B of FIG. 16A.

In certain embodiments, the aperture 119B in scissors attachment bracket 116B receives pin or bolt 32 and corresponding nut or retainer 32A to secure a lift chain, rope or other tether 30 as best seen in FIGS. 16A and 16B. As in other embodiments, preferably the nut includes a radial through-hole to receive a cotter pin 32B to prohibit the nut from inadvertently loosening or falling off, such as due to vibration.

Figure 6:
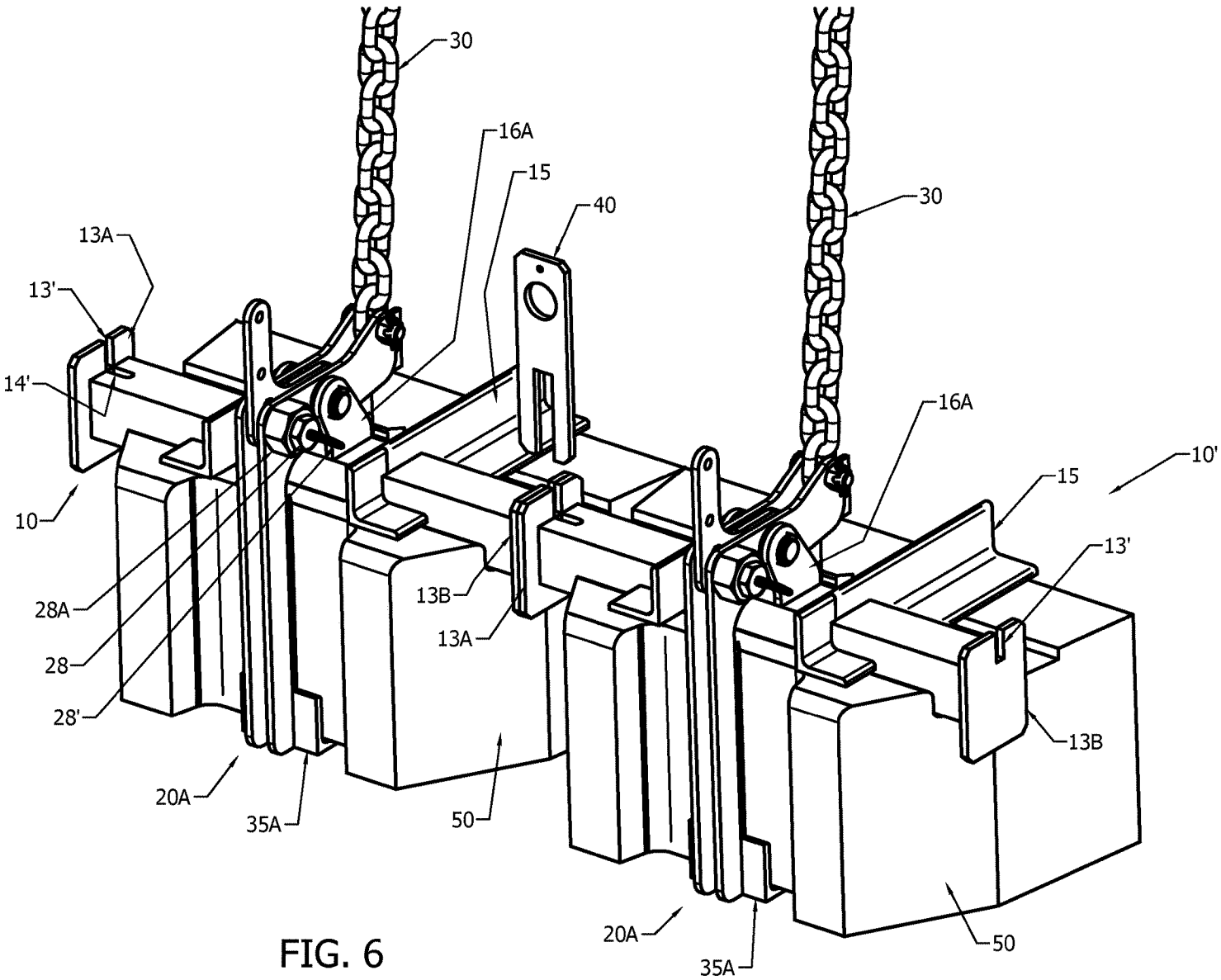
FIG. 6 is a perspective view of two lifting apparatuses in side-by-side relation prior to coupling them together.
Figure 7:
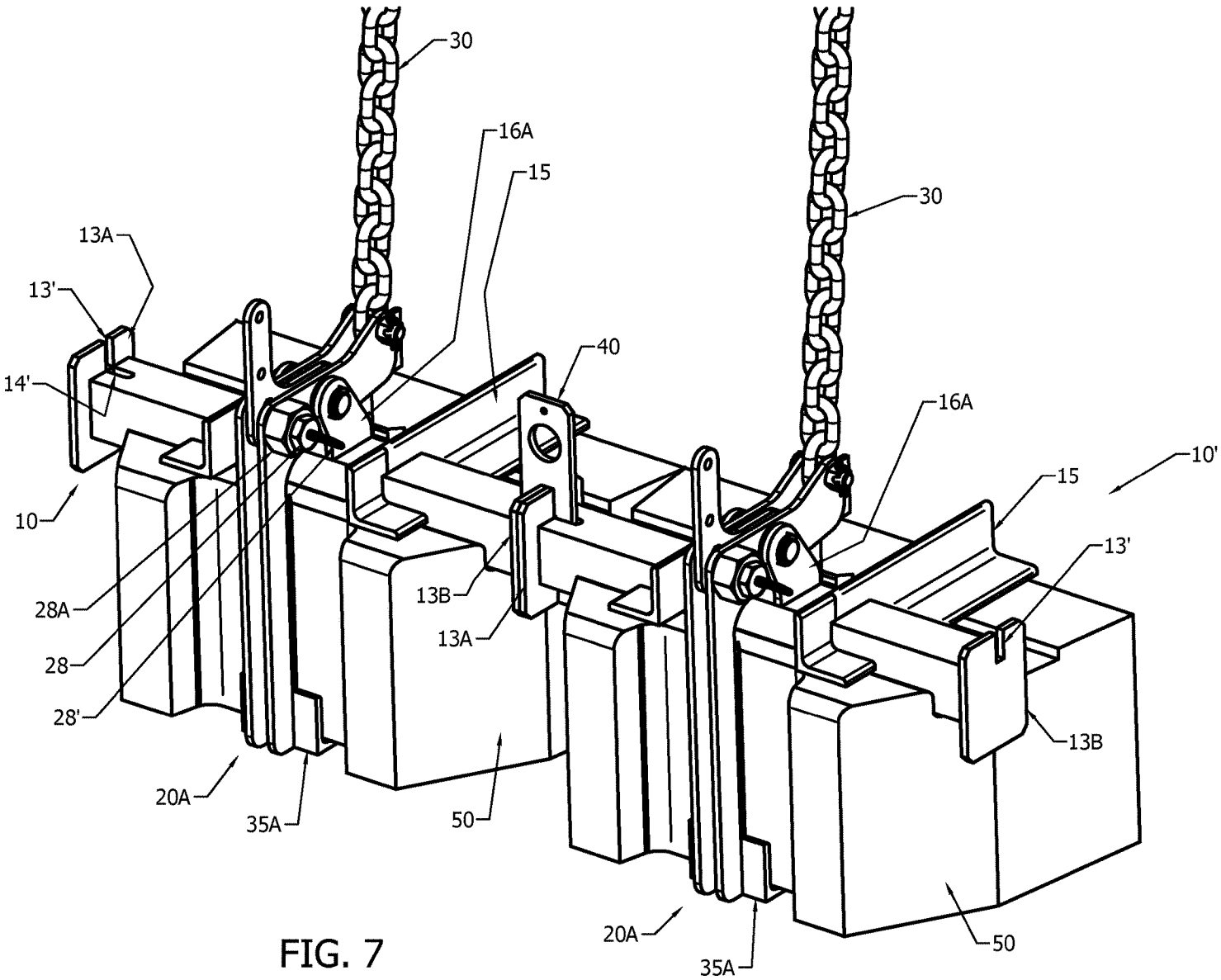
FIG. 7 is a perspective view of two lifting apparatuses coupled together in side-by-side relation.

FIGS. 6 and 7 illustrate an embodiment where a plurality of lifting apparatuses are assembled in modular form. As shown in FIG. 6 (where handle 60 is omitted for clarity), in some embodiments two lifting apparatus 10, 10' are positioned in side-by-side relation with one alignment plate 13B of lifting apparatus 10 abutting against one alignment plate 13A of lifting apparatus 10'. In certain embodiments, the alignment bar 14 and the alignment plates 13A, 13B may be have respective slots 14', 13', such as horseshoe-shaped slots. Each slot 14' may be aligned with a respective slot 13' as shown. When two lifting apparatuses 10, 10' are positioned in side-by-side relation, the slots 14', 13' from one lifting apparatus are aligned with the slots 14', 13' from a second lifting apparatus, and the two lifting apparatuses may be coupled together such as by inserting a coupling bracket 40 into the slots, as shown in FIG. 6 (uncoupled) and FIG. 7 (coupled). The slot 41 in the slotted bracket 40 allows the coupling bracket to accommodate the height of the alignment plates 13A, 13B and insert into the slots 14'. The number of lifting apparatuses that can be coupled together is not limited.

Alternatively, a plurality of lifting apparatuses may be integral or permanently coupled together in side-by-side relation.

Figure 8:
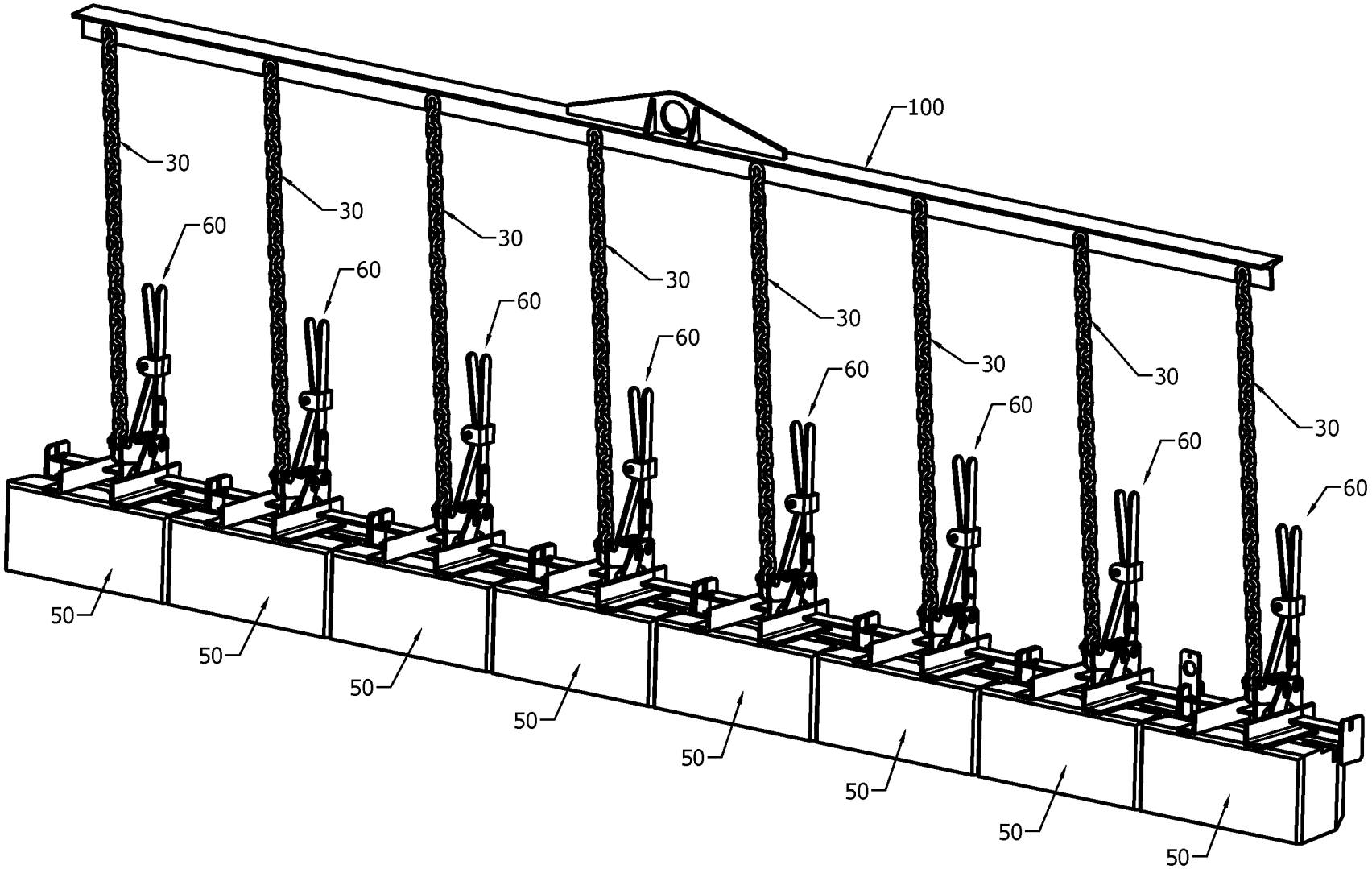
FIG. 8 is a perspective view of a modular unit including a plurality of lifting apparatuses supporting a plurality of blocks in side-by-side relation in accordance with certain embodiments.
Figure 9:
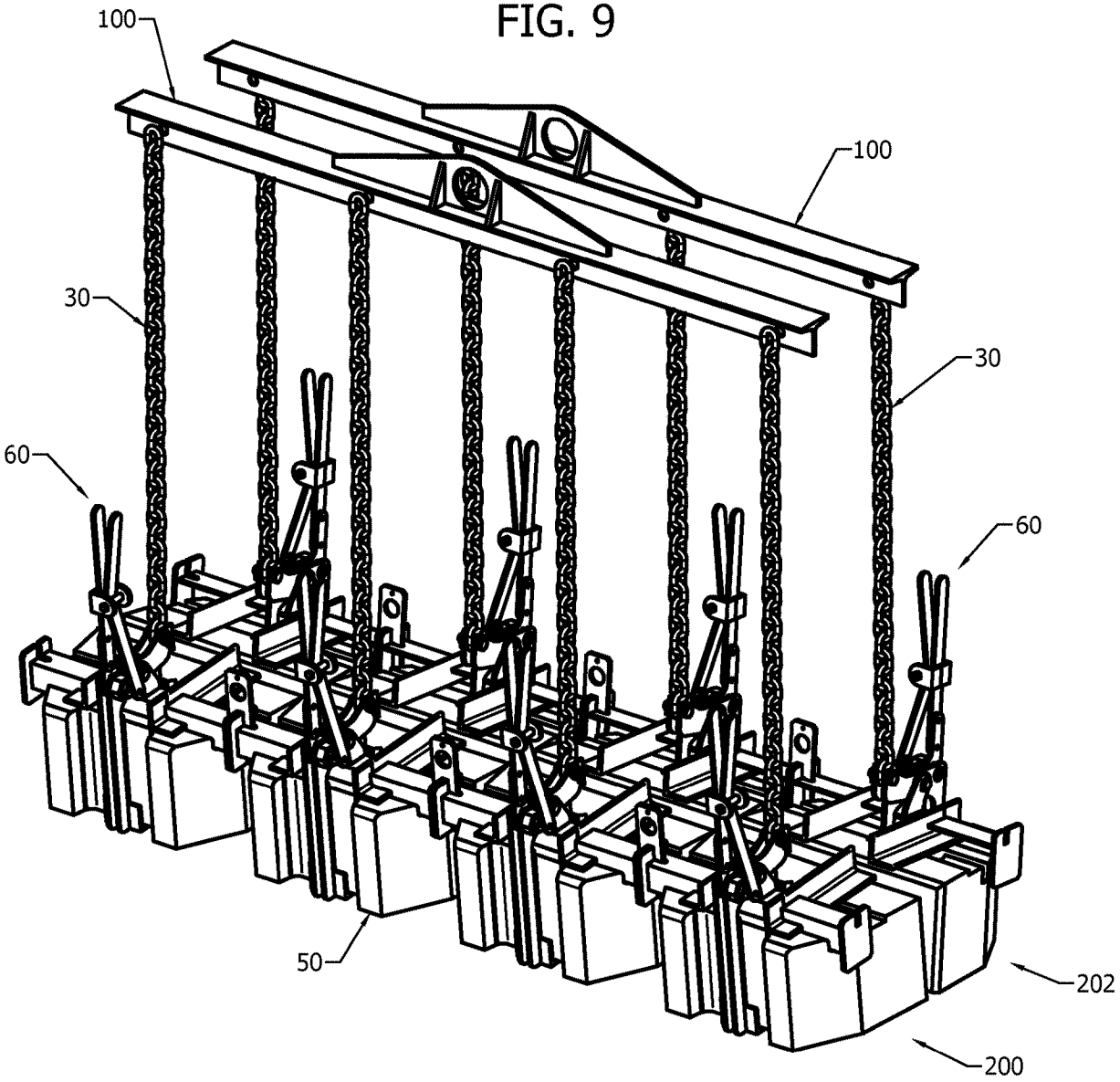
FIG. 9 is a perspective view of a modular unit including two sets of a plurality of lifting apparatuses supporting a plurality of blocks in side-by-side and front-to-front relation in accordance with certain embodiments.
Figure 10:
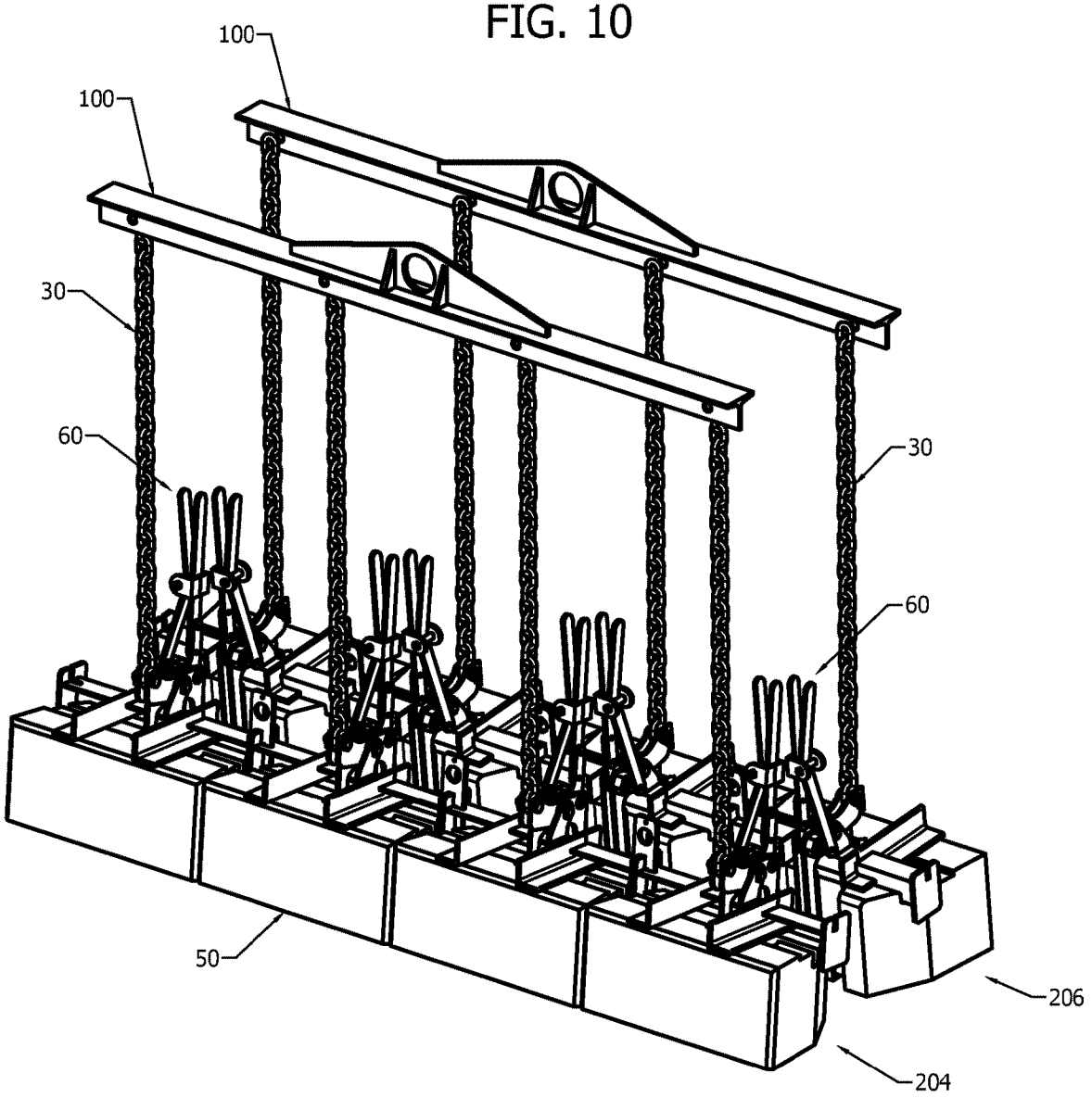
FIG. 10 is a perspective view of a modular unit including two sets of a plurality of lifting apparatuses supporting a plurality of blocks in side-by-side and back-to-back relation in accordance with certain embodiments.
Figure 11:
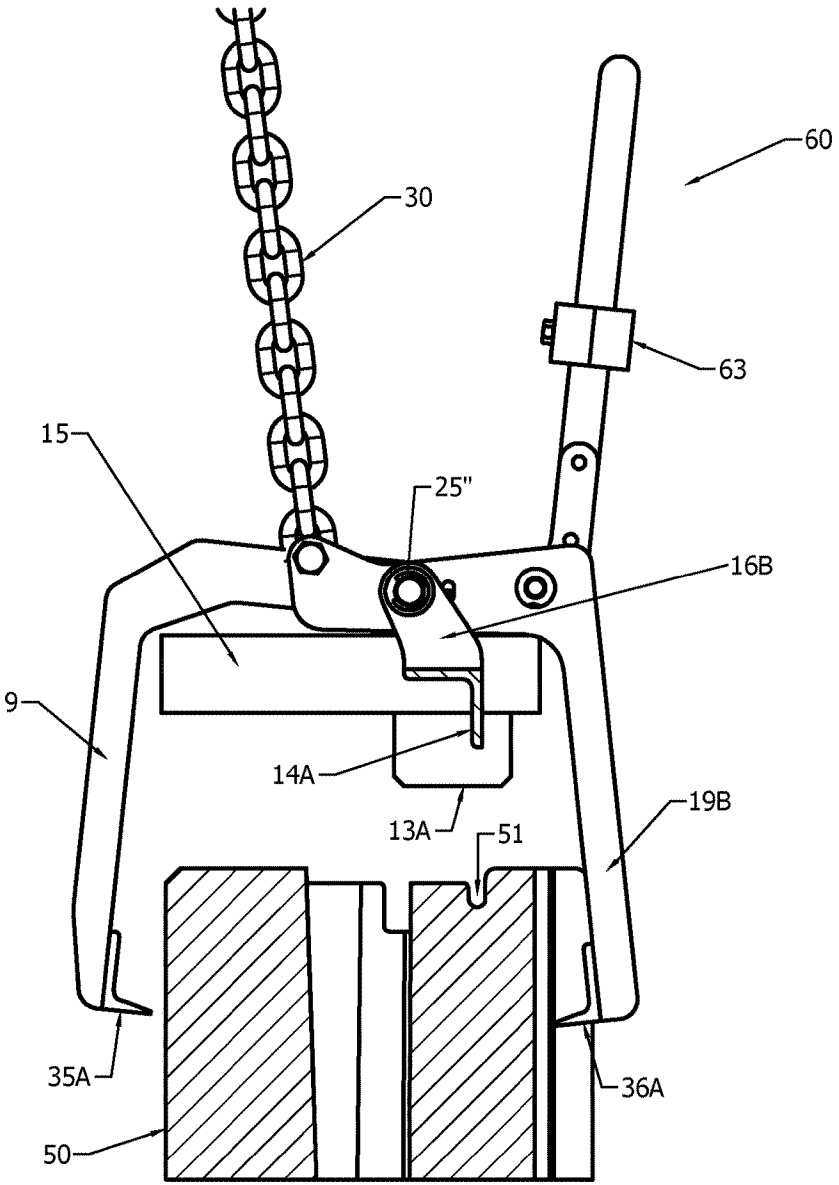
FIG. 11 is a side view, partially in cross-section, of a lifting apparatus in an open, unlocked and block unsupported position, in accordance with an alternative embodiment to FIG. 2.
Figure 12:
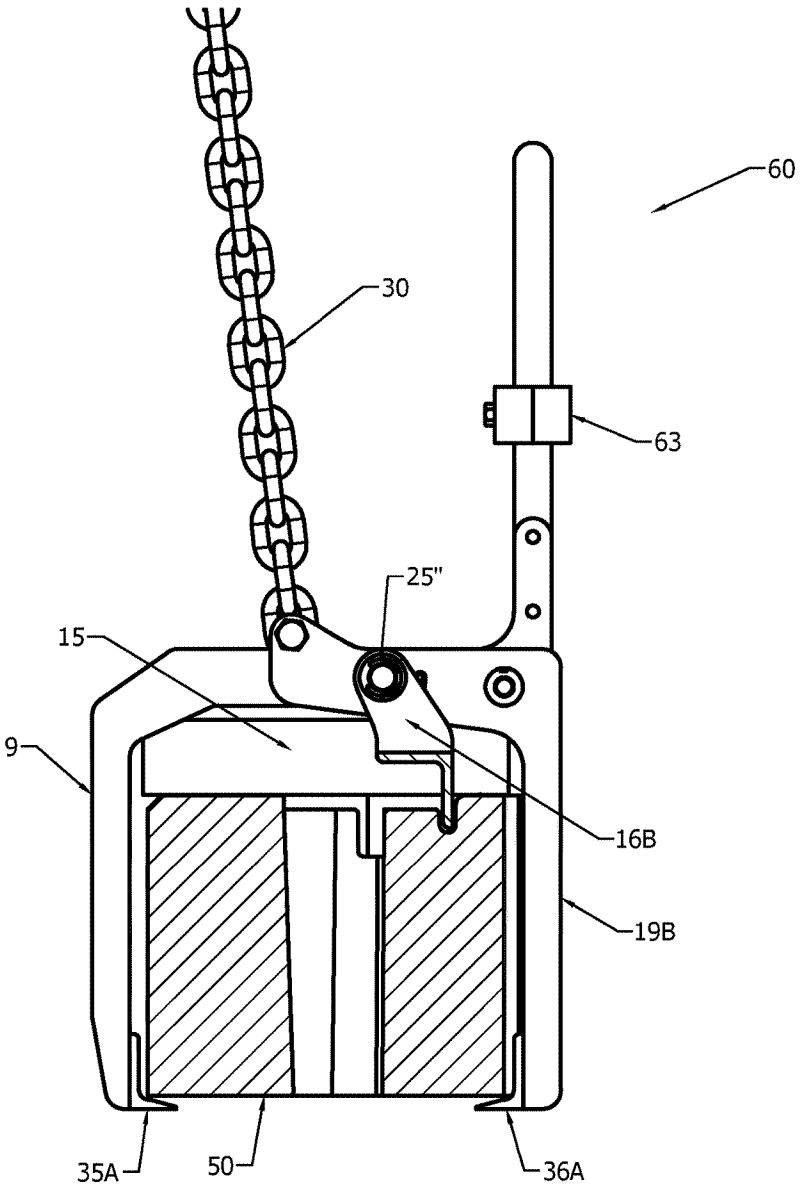
FIG. 12 is a side view, partially in cross-section, of a lifting apparatus in a block-engaged and supported positioned in accordance with an alternative embodiment to FIG. 3.
Figure 13:
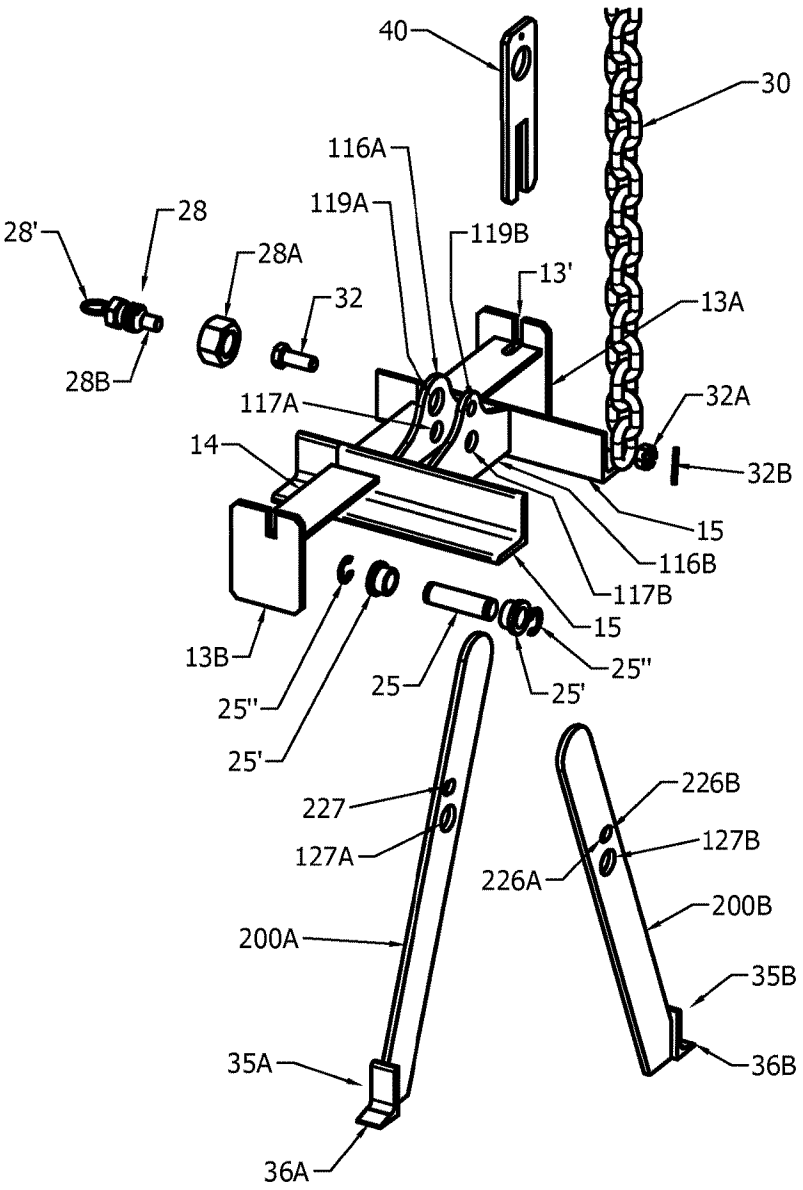
FIG. 13 is an exploded view of a lifting apparatus in accordance with an alternative embodiment where both mechanical scissor grips are configured to support a block by entering the block through a void or core in the block.

In some embodiments, it is advantageous to couple four lifting apparatus together (or use a single integral unit having four lifting mechanisms) so as to simultaneously lift a plurality of blocks or slabs, such as four blocks or eight blocks 50 (FIG. 8). In other embodiments, a plurality of lifting apparatuses coupled together in modular form may be used together with a second plurality of lifting apparatuses to lift, convey and/or position a plurality of blocks arranged in two rows 200, 202 such that the blocks in row 200 face the blocks in row 202 (i.e., are arranged front-to-front (face-to-face) (FIG. 9)), or arranged in two rows 204, 206 such that the blocks in row 204 butt the blocks in row 206 (i.e., are arranged back-to-back (FIG. 10)). Preferably the number of lifting apparatuses in the first plurality or row matches the number of lifting apparatuses in the second plurality or row. In a particularly preferred embodiment, there are four lifting apparatuses in each of the first and second rows or plurality of lifting apparatuses, enabling the simultaneous lifting, conveying and/or positioning of eight blocks or slabs. This is especially advantageous since often the blocks or slabs are delivered on pallets in layers or stacks of eight, and thus this particular assembly of lifting apparatuses allows for the lifting of an entire layer of blocks at the same time. Thus, for example, four blocks can be positioned at once, and then the assembly may be rotated 180° to position the remaining four blocks.

The components of the lifting apparatus 10 may be made of any suitable rigid material strong enough to lift, convey and position blocks or slabs. One suitable material of construction is structural steel. Another suitable material of construction is sheet metal, such as 3/16" or 1/4" inch thick sheet metal, that can be formed into the desired shapes to create an interlocking design, thereby eliminating some or all of the welding for assembly. Plastics, fiberglass and combinations thereof also may be suitable.

Suitable blocks or slabs 50 that may be lifted, conveyed and/or positioned with the lifting apparatus 10 may have an internal void 52 defined by at least one internal wall 52A (FIG. 3), or a plurality of internal voids defined by a plurality of internal walls. Others may be not have an internal void. Suitable blocks are blocks that are commercially available and used in civil engineering applications such as for retaining walls for earth retention, or in gardening or landscaping applications. Such blocks are available in various sizes, shapes and weights including, but not limited to, 8" h×18" w×12" d+/−, 8" h×12" w×11" d+/−, 16" h×6" w×12" d and 6" h×16" w×12' d'. The lifting apparatus(es) 10 may be used to position blocks or slabs in any of various arrays or patterns to construct retaining walls, for example. In some embodiments, the blocks are irregular; e.g., the front or face of the block may have a different configuration than the rear or back of the block.

In operation, in certain embodiments the lifting apparatus 10 may be positioned to engage a block or slab, where the biasing arm 28B of spring pin 28 is positioned in aperture 26A. The mechanical scissors grips are positioned so that the support legs 36A, 36B are positioned underneath the block, and spring pin 28 is actuated to move the biasing arm 28B axially either directly or by squeezing handle 60, to remove the biasing arm 28B of spring pin 28 from aperture 26A and then releasing the biasing arm 28B into aperture 26B once the mechanical scissors grips are pivoted, to lock the mechanical scissors grips into the block engaged positioned as shown in FIG. 3. In this embodiment this pivot action causes the block support angles 35A, 35B of the mechanical scissors grips 20A and 20B to move towards each other, from a block unengaged and unsupported position to a block engaged and supporting position. The block may now be lifted by raising the chain 30, such as with a motorized construction vehicle such as an excavator, skid steer loader, a crane, a tractor, a back hoe, etc. Where a plurality of lifting apparatuses are assembled in modular form, one or more of the chains 30 may be attached to a common beam or spreader bar 100 or the like (FIGS. 8-10) and the chains may be of the same length so that all of the blocks may be lifted simultaneously. Upon resting the block on a substrate, the load on the chain is mitigated or eliminated, and the mechanical scissors grips may be pivoted to their open position by actuating the locking pin 28, and/or operating the handle 60, causing the mechanical scissors grips 20A and 20B to pivot back towards their block unengaged and block unsupported position, thereby releasing the bias of the block support angles against the block and releasing the block. In this way, blocks may be conveyed one-by-one or in groups and placed in a predetermined pattern to form a structure such as a wall.

In embodiments where multiple blocks are lifted with multiple lifting apparatuses, preferably the chains 30 for each lifting apparatus are attached to the same actuator (e.g., the same construction vehicle).

What is claimed is:

1. A method of lifting from a surface a block having first and second external walls and a top surface, comprising:

positioning respective first and second supporters of a lifting apparatus alongside first and second external walls of the block in a first block release position, said lifting apparatus including one or more block stabilizers;

moving the first and second supporters to a second block support position, causing the first and the second supporters to position underneath said block to support said block;

stabilizing said block by causing said one or more block stabilizers to engage said top surface of said block; and raising the lifting apparatus to lift the block off of the surface.

2. The method of claim 1, further comprising conveying said block to a predetermined location and releasing said block from said first and second supporters.

3. The method of claim 2, wherein said positioning, moving, raising, conveying and releasing steps are repeated with a plurality of times with a plurality of blocks so as to construct a wall.

4. A method of lifting from a surface a block having an internal void and a top surface, comprising:

positioning a first supporter of a lifting apparatus in said internal void of the block, the internal void being defined by at least one internal wall of the block, said lifting apparatus including one or more block stabilizers;

positioning a second supporter of said lifting apparatus to engage an external wall of the block, the first and second supporters being in a first block release position;

moving the first and second supporters to a second block support position underneath said block;

causing said one or more block stabilizers to engage said top surface of said block and stabilize said block; and raising the lifting apparatus to lift the block off the surface.

5. The method of claim 4, further comprising conveying said block to a predetermined location and releasing said block from said first and second supporters.

6. The method of claim 5, wherein said positioning, moving, raising, conveying and releasing steps are repeated with a plurality of times with a plurality of blocks so as to construct a wall.

7. A method of lifting from a surface a block having an internal void and a top surface, comprising:

positioning a first supporter of a lifting apparatus in said internal void of the block, the internal void being defined by at least one internal wall of the block, said lifting apparatus including one or more block stabilizers;

positioning a second supporter of said lifting apparatus in said internal void of the block, the first and second supporters being in a first block release position;

moving the first and second supporters to a second block support position underneath said block;

causing said one or more block stabilizers to engage said top surface of said block and stabilize said block; and raising the lifting apparatus to lift the block off the surface.

8. The method of claim 7, further comprising conveying said block to a predetermined location and releasing said block from said first and second supporters.

9. The method of claim 8, wherein said positioning, moving, raising, conveying and releasing steps are repeated with a plurality of times with a plurality of blocks so as to construct a wall.

10. A lifting apparatus, comprising:

a main frame comprising an alignment bar, a pair of spaced alignment plates attached to said alignment bar, and a pair of spaced scissor attachment brackets attached to said alignment bar;

first and second mechanical scissor grips pivotally attached to said scissor attachment brackets, the first and second mechanical scissor grips being movable between an unengaged position and an engaged position; and a handle cooperating with said first mechanical scissor grip and configured for manual actuation of said first mechanical scissors grip between said unengaged and engaged positions.

11. The lifting apparatus of claim 10, wherein said second mechanical scissors grip is configured to be coupled to a tether.

12. The lifting apparatus of claim 10, further comprising a locking pin for locking said first and second mechanical scissors grips in said engaged position.

13. A modular lifting assembly for lifting a plurality of blocks off of a surface, said modular lifting assembly comprising a plurality of block lifting units, each of said block lifting units comprising: a main frame comprising an alignment bar, first and second spaced alignment plates attached to said alignment bar, and a pair of spaced scissor attachment brackets attached to said alignment bar;

first and second mechanical scissor grips pivotally attached to said scissor attachment brackets, the first and second mechanical scissor grips being movable between an unengaged position and an engaged block supporting position;

wherein the first spaced alignment plate of one of said plurality of block lifting units is coupled to a second alignment plate of another one of said plurality of block lifting units to position the block lifting units in side-by-side relation.

14. The modular lifting assembly of claim 13, wherein said second mechanical scissors grip is configured to be coupled to a tether.

15. The modular lifting assembly of claim 13, further comprising a locking pin for locking said first and second mechanical scissors grips in said engaged position.

* * * * *